United States Patent [19]

Ferguson

[11] 4,169,302

[45] Oct. 2, 1979

[54] FABRIC COVERED BUTTON

[76] Inventor: Bruce A. Ferguson, 233 S. Quincy, Hinsdale, Ill. 60521

[21] Appl. No.: 911,447

[22] Filed: Jun. 1, 1978

[51] Int. Cl.[2] ..... A44B 1/12

[52] U.S. Cl. ..... 24/113 R

[58] Field of Search ..... 24/113 R, 92, 90 C, 24/90 B

[56] References Cited

U.S. PATENT DOCUMENTS

| | | | |
|---|---|---|---|
| 2,602,975 | 7/1952 | Wolfe | 24/113 R |
| 2,799,908 | 7/1957 | Morin | 24/113 R |
| 3,829,935 | 8/1974 | Critchfield | 24/113 R X |
| 3,934,314 | 1/1976 | Whysall | 24/113 R |

*Primary Examiner*—Philip C. Kannan

*Attorney, Agent, or Firm*—Jakala, Knechtel, Valentino, Demeur & Dallas

[57] ABSTRACT

A fabric covered button which is of a two-piece construction and includes a button portion which advantageously can have any one of a number of different types of securement means integrally or otherwise formed with it, and a locking ring. The button portion consists of a button head having a stem having a plurality of serrations formed annularly in it integrally formed with the underside of the button head. Any one of a number of different attachment means are or can be integrally formed with the stem, at the terminal end thereof. The fabric is draped over the button head and extended around its edge to the rear thereof. A flat washer-like locking ring having an interior diameter proportioned to forcibly fit over the stem lockingly engages with the respective ones of the serrations. The edges of the fabric at the rear of the button head are lockingly secured between the rear of the button head and the locking ring, by the locking ring when it is secured in place to the stem. The plurality of serrations provide compensation for fabrics of different weights.

2 Claims, 7 Drawing Figures

FABRIC COVERED BUTTON

This invention relates to improvements in fabric covered buttons and to the method for fabricating them.

Buttons of the type with which the invention is concerned, i.e., fabric covered buttons, are well-known and have been in use for many years. Such buttons have been and are used in a variety of different applications, two of the principal ones of which are probably dressmaking and upholstering. The buttons are generally covered with a fabric or other material which matches the particular garment or article such as an upholstered chair or sofa. Buttons of this type are disclosed in at least the following U.S. Pat. Nos., namely, 174,161; 202,907; 1,164,460; 2,649,634; 2,716,794; 3,425,101; and 3,934,314.

The existing fabric covered buttons all generally comprise a stamped metal shell which is formed to receive on the back side thereof a stamped metal disc. In assembling the buttons, the fabric is draped or wrapped over and around the sides of the shell, and then the disc is forcibly or otherwise urged into the back side of the shell so as to captivate the fabric between the interior periphery of the shell and the outer periphery of the disc. The disc is sometimes provided with prongs or the like to more securely retain the fabric about the shell and to secure the disc and the shell together as an assembly.

While these fabric covered buttons have been used for many years, and have been substantially improved upon over the years, most of them are objectionable for one reason or another, and all of them are objectionable in that in too many cases, the disc becomes separated from the shell, thus permitting the fabric to become separated from the button. In many cases, the disc, as well as functioning to complete the assembly of the button and to contain the fabric about the shell, also is formed or provided with securement means for fastening the buttons to a garment or an article. In such cases, the various forces and stresses exerted upon the button pull or otherwise disengage the disc from the shell so that only the disc remains attached while the shell and the fabric covering are lost. This deleterious result has, to some extent, been overcome by, in some constructions, affixing the securement means to the shell and then adapting the disc to receive therethrough the securement means so that the latter then can be used to affix the button to a garment or an article. However, such constructions do not fully overcome the problem, for the fabric still is secured about the shell by means of the disc and the disc still, in too many cases, becomes dislodged so that the fabric becomes loose or lost.

In most cases, the shells and the discs are stamped from a thin metal and the securement means are wire loops or the like secured in some fashion, e.g., by welding, to either the disc or the shell. In those constructions where the wire securement means is affixed to the shell, the front exposed face of the shell, once the fabric is lost, usually is marred or otherwise disfigured so that the bare shell is generally unsightly to an observer and ruins the appearance of the garment or article.

While, as indicated above, substantial improvements have been made to the construction of these fabric covered buttons, in an attempt to overcome various objectionable features associated with it, each improvement generally has increased the cost of material or manufacture and assembly, or both.

A factor which must be taken into consideration in the design of any new button of this type is the fact that most garment, upholstery and other manufacturers who utilize these buttons do not make them, but purchase them from button manufacturers. In addition, these users many times do not assemble these buttons, i.e., place the fabric on them, but instead, simply supply the fabric and have the assembly done by others. The larger users may assemble the buttons themselves. In any case, the buttons are generally assembled using dies or tools specifically designed for this purpose, thus the adoption of any new button construction normally likewise requires the purchase the new dyes or tools.

Another factor which also must be taken into consideration is that the components or button parts from which the fabric covered buttons are formed are sold, usually in kits, to housewives, amateur dressmakers and the like, who form or assemble their own fabric covered buttons. The components or button parts therefor should be of a construction which permits the utilization thereof in such kits.

The fabric covered button of the present invention or, more particularly, the components or button parts which are used in forming or assembling a fabric covered button is of a two-piece construction and includes a button portion which advantageously can have any one of a number of different types of securement means integrally or otherwise formed with it, and a locking ring. The button portion consists of a button head having a stem having a plurality of serrations formed annularly in it integrally formed with the underside of the button head. Any one of a number of different attachment means are or can be integrally formed with the stem, at the terminal end thereof. The fabric is draped over the button head and extended around its edge to the rear thereof. A flat washer-like locking ring having an interior diameter proportioned to forcibly fit over the stem lockingly engages with the respective ones of the serrations. The edges of the fabric at the rear of the button head are lockingly secured between the rear of the button head and the locking ring, by the locking ring when it is secured in place to the stem. The plurality of serrations provide compensation for fabrics of different weights, as more particularly described below.

The button head preferably and advantageously is molded of plastic, although other materials can be used. The button heads can be molded in different colors so that the button heads can be selected to coordinate with the color of the fabric. By doing so, in the event that the garment and/or the fabric covered buttons are subjected to abuse or unusual wear which results in the inadvertent loss of the fabric covering, the button head will blend with the fabric and will not stand out in contrast with the fabric, as in the case of existing stamped metal button shells and/or the stamped metal disc. The button head also can be textured to add a decorative finish, as well as color, to the exposed button head.

Accordingly, it is an object of the present invention to provide improvements in fabric covered buttons and, more particularly, improvements to and in the method for fabricating them.

The invention and the preferred features thereof outlined above will now be described in greater detail, with reference to the accompanying drawings in which.

DESCRIPTION OF THE PREFERRED EMBODIMENT

Figure 1:
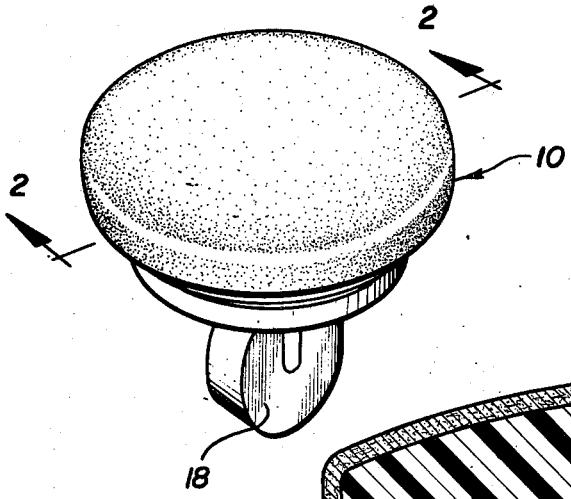
FIG. 1 is a perspective view of a button exemplary of the present invention.

Referring now to the drawings, in FIG. 1 there is illustrated a fabric covered button 10 which, in accordance with the invention, includes components or button parts which are used in forming or assembling it. These components or button parts include a button portion 12 (FIG. 2) and a locking ring 22 (FIG. 3) which functions to secure the fabric 20 to the button 10, all as more fully described below.

Figure 2:
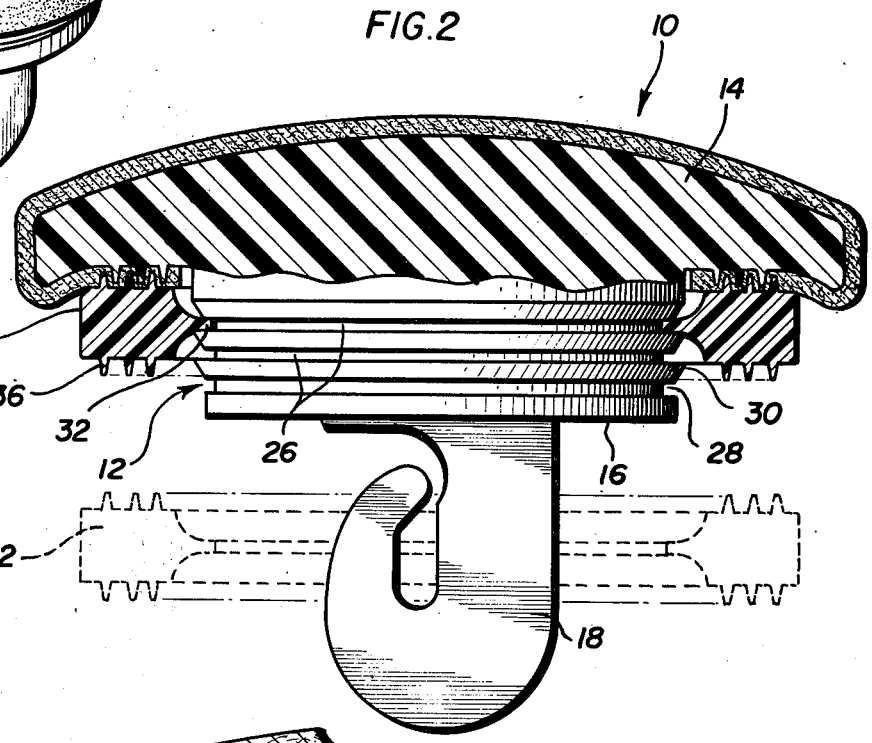
FIG. 2 is a sectional view taken along lines 2—2 of FIG. 1.
Figure 3:
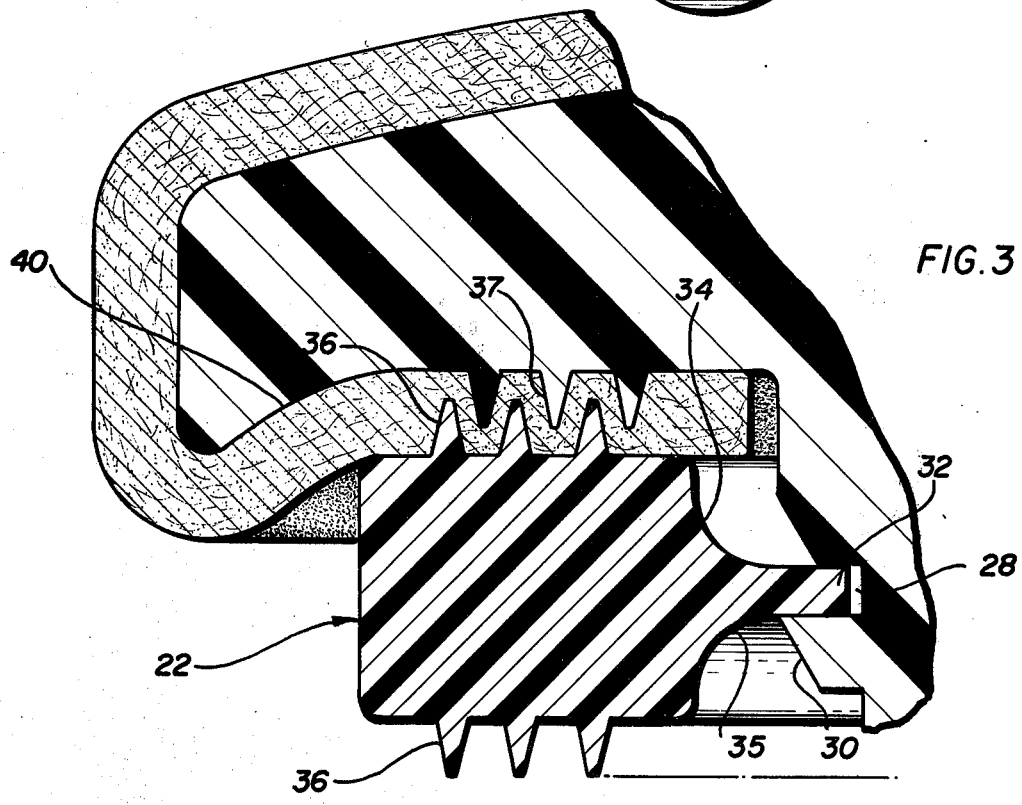
FIG. 3 is an enlarged partial sectional view.

As can be best seen in FIG. 2, the button portion 12 includes a button head 14 which has a concave head portion on the upper end thereof and a stem 16 of a reduced diameter integrally formed with the button head 14 on the under side thereof. Attachment means 18, such as the hook illustrated in FIG. 1, is integrally formed with the terminal end of the stem 16. Various other attachment means 18 likewise can be integrally formed with the stem 16, depending upon the particular application for the fabric covered button 10.

The stem 16 of the button portion 12 has a plurality of serrations 26 formed annularly about its peripheral surface. More particularly, the serrations 26 are formed by means of a plurality of spaced apart annular grooves 28, formed in the stem 16. Tapered edges 30 are provided on the stem 16, adjacent each of the annular grooves 28 formed therein, to provide camming surfaces which coact with the locking ring 22 to affix the latter to the stem 16, all as more particularly described below.

Figure 4:
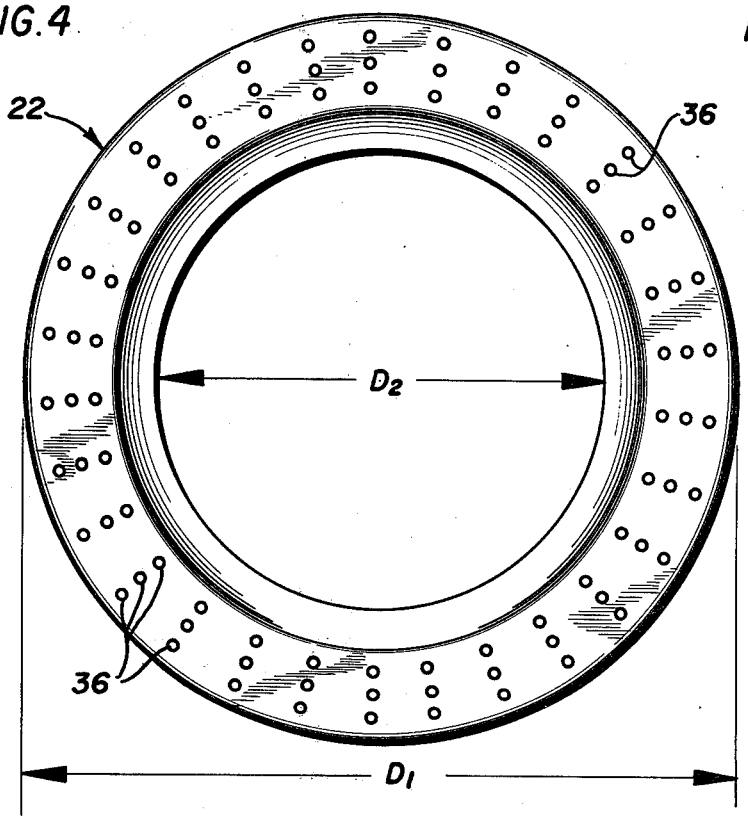
FIG. 4 is a bottom plan view of the locking ring.
Figure 5:
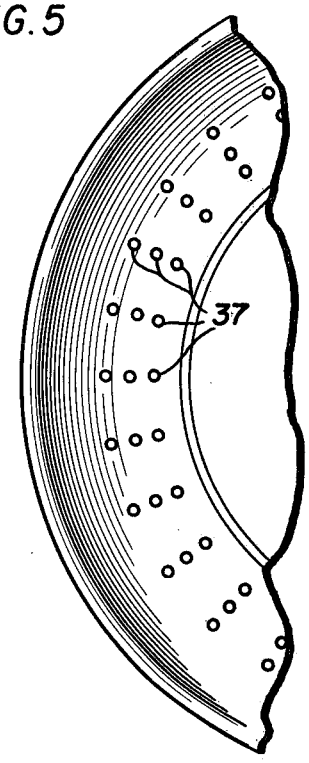
FIG. 5 is a partial bottom plan view of the button head.

The locking ring 22, as can be best seen in FIG. 4, has an outer diameter $D_1$ which is smaller but substantially corresponds with the diameter of the button head 14 of the button portion 12, so that the locking ring 22 is substantially concealed by the button head 14. The interior diameter $D_2$ of the locking ring 22 is slightly smaller than the diameter of the stem 16, so that the locking ring 22 must be forcibly and slidably assembled with the stem 16, as described more fully below. The locking ring 22 has an annular inwardly projecting flange 32 centrally thereof. This flange 32 has a thickness which is slightly smaller but substantially corresponding to the width of the annular grooves 28 formed in the stem 16 and is of a length which likewise substantially corresponds to the depth of the annular grooves 28 in the stem 16, so that the flange 32 will lockingly engage within one of the serrations 26 or annular grooves 28 in the stem 16, to affix the locking ring 22 to the stem 16. The interior peripheral edges 34 and 35 of the interior diameter of the locking ring 22 are tapered inwardly and downwardly to converge with the annular flange 32. Both the upper and lower surfaces of the locking ring 22 are provided with a number of upstanding pointed teeth 36 which are arranged in concentric circle (three, as illustrated) which teeth are positioned to intermesh with pointed teeth 37 similarly formed on the underside of the button head 14 to lockingly engage the fabric 20 to the button 10.

In assembling the fabric covered button 10, the fabric is draped over the button head 14 and extended around its edge to the rear thereof, as can be best seen in FIG. 2. The locking ring 22 is forcibly and slidably fitted over the serrations 26 in the stem 16, until the fabric is pressed against the underside of the button head 14, with the teeth 36 on the locking ring 22 and the teeth 37 on the underside of the button head 14 intermeshed and lockingly engaged with the fabric. The locking ring 22 is secured with the button head 14, by means of the flange 32 which lockingly engages within one of the serrations 26 or annular grooves 28 in the stem 16. The various ones of the serrations or annular grooves 28 provide compensation for fabrics of different weights, by providing a larger or smaller spacing between the underside of the button head 14 and the top side of the locking ring 22 into which the fabric is received. It may be noted that the locking ring 22 is reversible, so that it may be affixed to the button head 14 with either side up.

It may also be noted that the underside of the button head 14 may be recessed with an inverted dish-shape depression 40 into which the fabric edge and locking ring 22 can fit. This depression helps, to some extent, to secure the fabric to the button 10, by re-distributing the forces exerted on the fabric which would tend to pull it from the button head so that an extreme lateral force on the edge of the fabric is required to pull the fabric loose.

Figure 6:
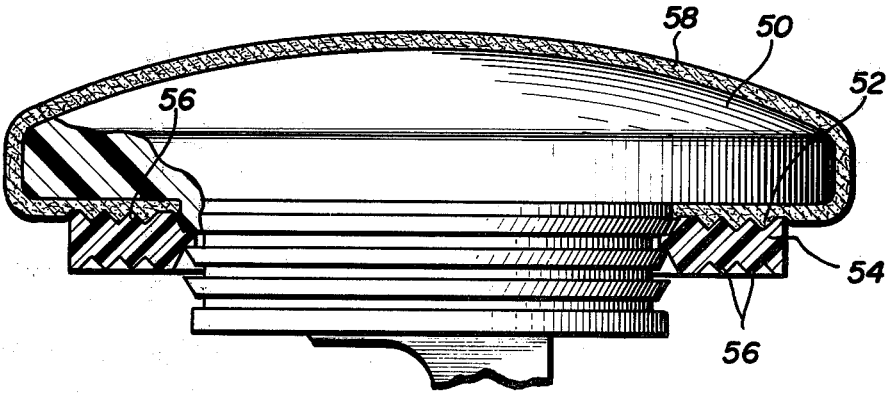
FIG. 6 is a side plan view, partially sectionalized, of a button exemplary of another embodiment of the invention.
Figure 7:
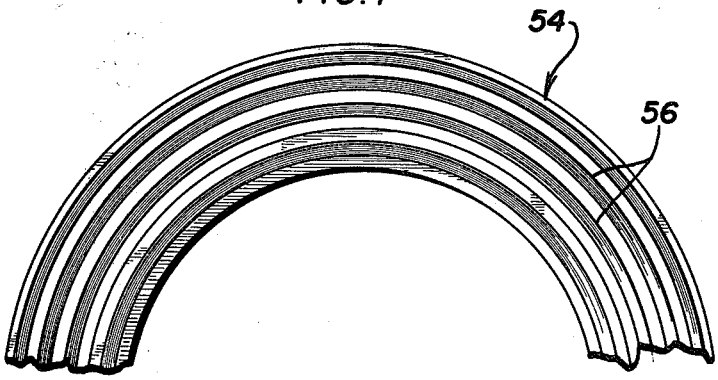
FIG. 7 is a partial bottom plan view of the locking ring.

In FIGS. 6 and 7, there is illustrated a similar button head 50, however, in this case, the underside thereof is essentially a flat surface upon which are provided a number (three, as illustrated) of concentric projecting pointed rings 52. The top and bottom surfaces of the locking ring 54 is correspondingly provided with a number of concentric projecting pointed rings 56 which positioned and proportioned to intermesh with the locking rings 52 to secure the fabric 58 to the button head 50. Otherwise, the construction and functions of the button head 50 and locking ring 54 are described above.

It will thus be seen that the objects set forth above, among those made apparent from the preceding description, are efficiently attained and certain changes may be made in the above article. Accordingly, it is intended that all matter contained in the above description, or shown in the accompany drawings shall be interpreted as illustrative and not in a limiting sense.

Now that the invention has been described, what is claimed as new and desired to be secured by Letters Patent of the U.S. is:

1. A fabric covered button comprising a button portion comprising a button head having on the rear face thereof a cylindrical-shaped stem of a diameter smaller than the dimensions of said button head and attachment means for securing said fabric covered button to an article integrally formed with the terminal end of said stem, said stem having a plurality of annular grooves in spaced-apart relationship along the length thereof, a piece of fabric draped over said button head and extended around its edge to the rear thereof, and a flat washer-like locking ring having a top side, a bottom side and an interior diameter proportioned to forcibly fit over said stem and to lockingly engage with the respective ones of said grooves, an annular inwardly projecting flange of a thickness and length substantially corresponding with the thickness and length of the annular grooves in said stem, said annular flange lockingly engaging within the respective ones of said grooves to secure said locking ring to said stem, the edges of said fabric at the rear of said button head being lockingly secured between the rear of said button head and said locking ring, the underside of said button head being substantially flat and having a plurality of concentrically arranged circles of projecting pointed teeth formed thereon, said locking ring further comprising a plurality of projecting teeth arranged in concentric circles so as to intermesh with said teeth on the underside of said button head to assist in securing said fabric to said button head, said teeth being provided on both the top and bottom side of said locking ring so that the latter is reversible, whereby said teeth on either said top side or said bottom side thereof can be intermeshed with said teeth on the underside of said button head to secure said fabric between the rear of said button head and said locking ring, the peripheral edge of said stem at each of said plurality of annular grooves being tapered to form camming surfaces which engage with said flange on said locking ring to assist in forcibly fitting said locking ring to said stem.

2. The fabric covered button of claim 1, wherein said teeth on the underside of said button head and said teeth on the top and bottom sides of said locking ring all are replaced with a plurality of annular concentrically arranged generally V-shaped locking grooves which are positioned and proportioned to intermesh to assist in securing said fabric to said button.

* * * * *